US005507572A

United States Patent [19]

Shields et al.

[11] Patent Number: 5,507,572

[45] Date of Patent: Apr. 16, 1996

[54] METHOD AND APPARATUS FOR SUPPLYING A CONTINUOUS PRODUCT STREAM OF LIME SLURRY TO A REMOTE JOBSITE

[75] Inventors: Patrick J. Shields, Scottsdale, Ariz.; Craig D. Girard, Arlington; James R. Scholl, Haslet, both of Tex.

[73] Assignee: Chemical Lime Company, Fort Worth, Tex.

[21] Appl. No.: 292,360

[22] Filed: Sep. 2, 1994

[51] Int. Cl.[6] ..... B28C 5/38

[52] U.S. Cl. ..... 366/6; 366/14; 366/34; 366/152.6; 366/153.1; 405/263

[58] Field of Search ..... 366/2, 6, 10, 13, 366/14, 15, 27, 28, 29, 33, 34, 40, 42, 43, 131, 132, 134, 136, 137, 159.1, 152.6, 153.1; 405/263, 264, 266, 268, 269, 270

[56] References Cited

U.S. PATENT DOCUMENTS

| | | | |
|---|---|---|---|
| 2,316,705 | 4/1943 | Morgan | 366/2 |
| 3,231,245 | 1/1966 | Harvey | 366/28 |
| 4,084,381 | 4/1978 | Cain | 405/266 |
| 4,955,723 | 9/1990 | Schneider | 366/153.1 |
| 5,275,487 | 1/1994 | Rumph | 366/14 |

*Primary Examiner*—Robert W. Jenkins

*Attorney, Agent, or Firm*—Charles D. Gunter, Jr.; Grady K. Bergen

[57] ABSTRACT

A method and apparatus for providing a continuous product stream of lime slurry to a job site which is located remote from a permanent lime production plant utilizes a primary and auxiliary tank which are mounted on a portable frame structure. Lime and water are mixed in the primary tank to form a lime slurry. The lime slurry is then introduced into the auxiliary tank. A product stream of lime slurry is drawn from the primary tank until it is depleted. Lime slurry is then drawn from the auxiliary tank to supply a continuous stream of lime slurry to the job site while the primary tank is being refilled with lime and water to form a second lime slurry. The second lime slurry is then introduced into the auxiliary tank so that it is filled again and a second product stream of lime slurry is drawn from the primary tank. The process is repeated until a desired amount of lime slurry is supplied to the job site. In an alternate embodiment, the product stream is drawn continuously from the auxiliary tank while the auxiliary tank is being replenished from the primary tank.

27 Claims, 3 Drawing Sheets

METHOD AND APPARATUS FOR SUPPLYING A CONTINUOUS PRODUCT STREAM OF LIME SLURRY TO A REMOTE JOBSITE

BACKGROUND OF THE INVENTION

1. Field of the Invention

This invention relates to the production of a continuous product stream of lime slurry to a jobsite which is remote from a lime production plant.

2. Description of the Prior Art

Lime has a variety of uses. It is commonly used in treating waste water and sewage. It is used in agriculture to neutralize acidic soils and to provide nutrients for sustaining plant life. Lime is also used extensively in construction for the stabilization of soils and as a component in a variety of building materials.

Lime, as referred to in this description, can be quicklime (calcium oxide (CaO)), hydrated lime (calcium hydroxide ($Ca(OH)_2$) or lime kiln dust. Quicklime is usually in the form of lumps or pebbles. Dry hydrated lime is usually a powder. In order to further process lime and improve the ease with which it is handled, dry lime is often mixed with water to form a slurry. In the case of quicklime, the water reacts with the quicklime in an exothermic reaction to form hydrated lime. This is often referred to as slaking. During the slaking of quicklime, large amounts of heat are given off which can significantly raise the temperature of the slurry.

Lime slurries can be made in batches or in a continuous process. If a particular user requires a large amount of lime slurry at a particular site, large capacity slaking and storage tanks can be permanently located on the site. These tanks can usually provide a sufficient supply of lime and lime slurry for most operations. Oftentimes, however, it is not practical to provide permanent slaking or storage tanks for forming lime slurries. In the agricultural industry and in some construction industries, lime may be required only periodically or during certain seasons. Here the limited use of lime may not justify the investment required for constructing and maintaining large capacity processing tanks and equipment. In other industries the location of the job sites may change from day to day, such as in road construction, so that permanently located processing and storage tanks would be impractical. Here, lime slurries would have to be made at permanent lime processing facilities and then pumped into tanks to be hauled to the specific job locations.

Portable equipment for forming lime slurries which can be moved from site to site, such as that described in U.S. Pat. No. 4,329,090 and which is hereby incorporated by reference, has been developed. One of the advantages of this type of equipment is that hot lime slurries formed during the slaking of quicklime can be used almost immediately, before any significant temperature drop. The use of these hot lime slurries has many advantages. In cold weather, the high temperature lime slurries are less likely to freeze and react more readily in temperature dependent reactions. When water is to be driven off, the high temperature of the slurry reduces the amount of energy needed to evaporate the water.

One of the shortcomings of the portable processing equipment is that the lime slurries are made in individual batches. After the lime slurry has been depleted, another batch must be made on site. This can be several hours, delaying the supply of lime slurry. Often it is crucial to have a continuous, uninterrupted supply of lime slurry. In hot mix asphalt plants, for instance, the continuous feeding and control of lime is essential.

What is needed is a means for forming a lime slurry at a remote job site while allowing the slurry to be fed in an uninterrupted, continuous product stream at a known concentration.

SUMMARY OF THE INVENTION

A continuous product stream of lime slurry can be formed at a remote jobsite by mounting a primary and an auxiliary tank to a portable frame structure. The frame structure is then positioned at the job site or other selected area. Lime and water are then introduced into the primary tank where they are mixed together to form a lime slurry. An amount of the lime slurry from the primary tank is then introduced into the auxiliary tank. A product stream of the lime slurry from the primary tank is drawn from the primary tank and supplied to the selected area or application point until the amount of lime slurry within the primary tank drops to a predetermined level. The second product stream of the lime slurry is then drawn from the auxiliary tank so that the lime slurry is continuously supplied to the application point without interruption. While this is occurring, a second quantity of lime and water are added to the primary tank and mixed together so that a second lime slurry is formed. This occurs while the lime slurry is being drawn from the auxiliary tank. The second lime slurry is then introduced or added to the auxiliary tank as described above and the process repeated until a desired amount of the lime slurry is supplied to the application point.

In another embodiment, an amount of lime slurry is initially added to the auxiliary tank. A product stream is then drawn from the auxiliary tank only while lime slurry is continuously fed from the primary tank to the auxiliary tank to maintain the amount of lime slurry in the auxiliary tank. When the lime slurry within the primary tank drops to a preselected level, a second quantity of lime and water are then introduced into the primary tank and mixed to produce the second quantity of second lime slurry while the product stream of lime slurry is being drawn from the auxiliary tank. The process is repeated until the desired amount of lime slurry is supplied to the selected area.

DETAILED DESCRIPTION OF THE INVENTION

As discussed previously, the lime used in this invention may be quicklime, hydrated lime or lime kiln dust. In many cases the use of quicklime may be preferable because of the heat generated during slaking and the ease with which the lumps or pellets of quicklime can be unloaded.

In forming lime slurries, the water used may vary in quality. Conventional water sources include city water mains, wells, railroad storage facilities, highway department storage facilities, lakes, streams, and the like. Preferably absent from the water should be materials, such as sulfite and sulfate ions, that would react with the lime when it is added to the slurry.

Figure 1:
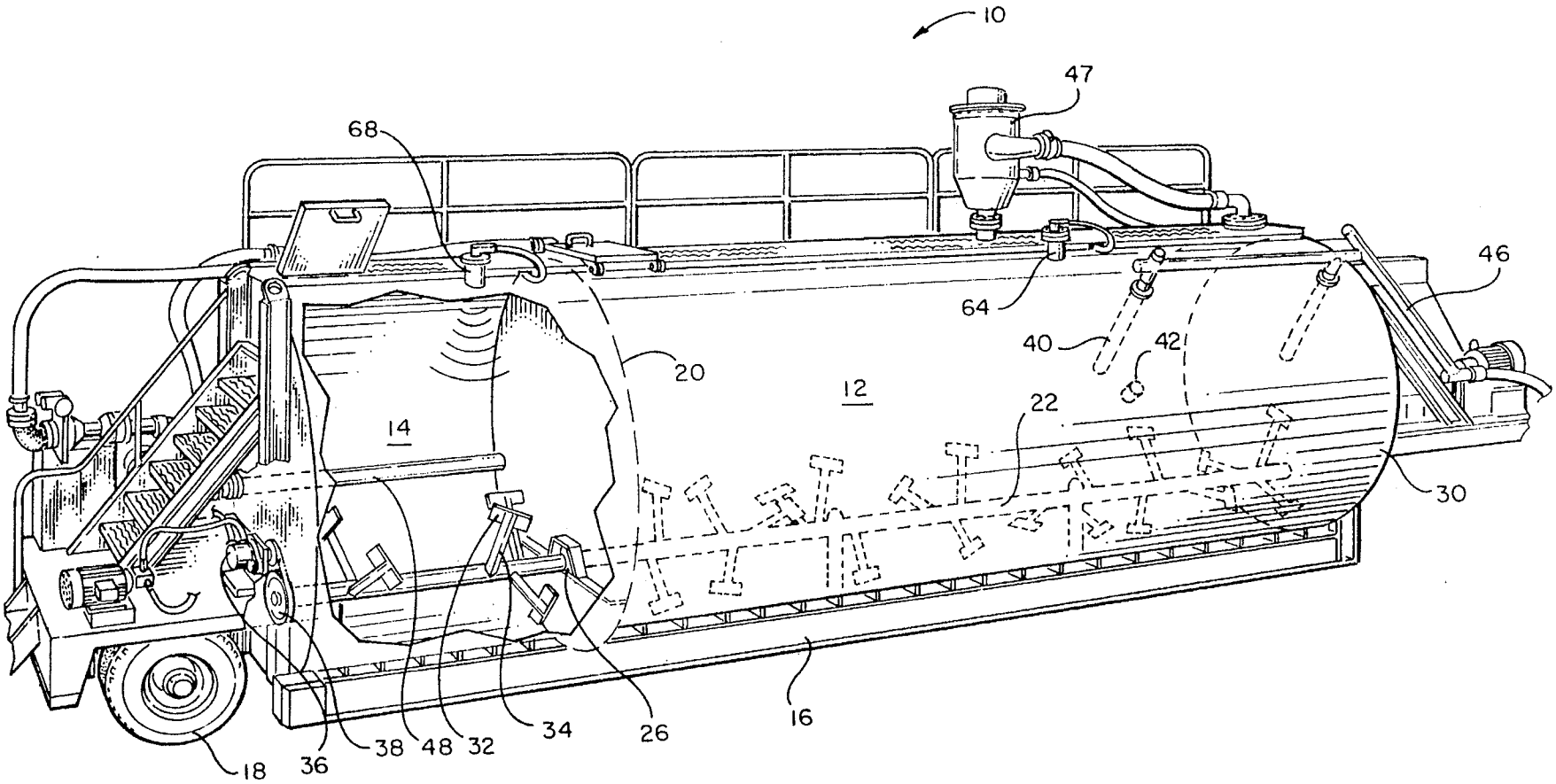
FIG. 1 shows a partially sectioned perspective view of an apparatus having a portable frame with a primary and an auxiliary tank mounted thereon having conduits for drawing product streams of lime slurry from only the auxiliary tank in accordance with the invention.

Referring to FIG. 1, an apparatus 10 used in performing the method of the invention is shown. The apparatus 10 has a primary mixing compartment or tank 12 and an auxiliary or feed tank 14 mounted on a frame structure 16. The tanks 12, 14, should be constructed of suitable materials able to withstand the high heat associated with the slaking of quicklime. The apparatus 10 should be of legal highway size so that it can be transported on public roads or highways. Typically, the apparatus 10 should not have a height greater than 13.5 feet nor a width greater than 10.5 feet. The primary tank 12 should be large enough to process about 25 tons of dry quicklime, which is typically the maximum legal highway load for lime. A tank having a maximum capacity of 24,000 gallons is suitable to process 25 tons of dry quicklime. The auxiliary tank 14 has a capacity substantially less than that of the primary tank 12. A volume or capacity approximately one-third that of the primary tank 12 is sufficient for most operations. As an example, the tanks 12, 14 may be cylindrical tanks, each tank having a diameter of approximately 10.5 feet, with the primary tank 12 having a length of 30 feet and the auxiliary tank 14 having a length of 10 feet.

The frame structure 16 may be a skid on which the primary and auxiliary tanks 12 and 14 are mounted and which can be moved from place to place. Preferably, wheels 18 are mounted to the frame structure 16 to facilitate transporting the apparatus 10 to desired locations. As shown in FIG. 1, the primary and auxiliary tanks 12, 14 are concentric cylindrical tanks which are joined together and separated by a common wall 20. A single rotatable shaft 22 extends through both the primary and auxiliary tanks 12, 14 and through the common wall 20 which divides the primary and auxiliary tanks 12, 14. The rotatable shaft 22 is supported on bearings 26 which are located in the common wall 20 and endwalls 30 of the primary and auxiliary tanks 12, 14. The bearing 26 located in the common wall 20 is a sealed bearing which prevents fluid from escaping or flowing between the tanks 12, 14 through the wall 20.

Located along the length of the shaft 22, are a plurality of mixing paddles 32. The paddles 32 are arranged in a spiral pattern, as illustrated in FIG. 1, and are connected to the rotatable shaft 22 by arms 34. The shaft 22 and paddles 32 are located near the bottom of the tanks 12, 14 to ensure that thorough mixing occurs as the liquid level within the tanks 12, 14 drops. The paddles 32 are angled to cause the particles of lime to flow along the length of the tanks 12, 14 and spirally intermix with the water. The paddles 32 may be constructed of mild steel or any other suitably strong material and may be used in combination with flexible paddles, such as plastic, neoprene or other synthetic rubber. The paddles 32 may also be formed of belting having rubber around heat resistant fibers, like fiberglass fibers or the like. It is necessary that they be able to withstand the high temperatures which are often encountered in the slaking of quicklime. These temperatures may be near the boiling point of water.

The rotatable shaft 22 is rotated by means of a hydraulically driven motor 36 and gears indicated at 38 which are mounted to the frame 16 external to the tanks 12, 14. A rotational speed within the range of 30–90 revolutions per minute has been found to be satisfactory for mixing the lime slurry.

Figure 2:
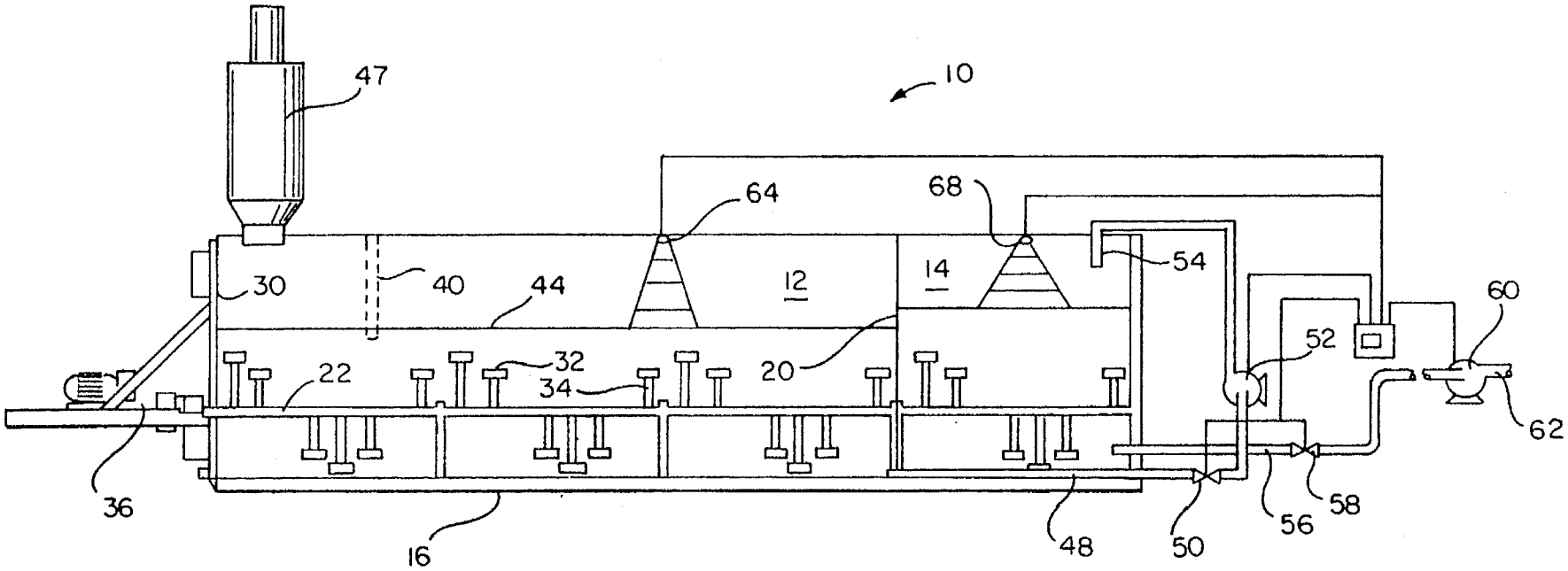
FIG. 2 is a schematic diagram of the apparatus of FIG. 1.

A lime inlet 40 is provided in the top portion of the primary tank 12 and extends downward for a predetermined distance, as shown in FIG. 2. A water inlet 42 is located in the side of the primary tank 12. After water is added to the tank 12 through water inlet 42 (FIG. 1) to a predetermined water level 44 (FIG. 2), the inlet conduit 40 will extend for approximately 1 to 2 feet below the water level 44. Quicklime or hydrated lime can then be introduced into the primary tank 12 through a feed hopper (not shown) or blown through a suitable pneumatic transport conduit 46 through the inlet conduit 40. A particulate scrubber 47 is provided with the primary tank 12 to control lime dust which tends to collect in the space above the water level 44. It is advisable to keep workmen off the tanks 12, 14 during the mixing of the quicklime or hydrated lime. The introduction of the lime below the surface 44 of the water ensures that the lime is thoroughly mixed and minimizes caking of the lime on the surface of the water.

A conduit 48 having a valve 50 and a centrifugal pump 52 is provided with the primary tank 12 for introducing lime slurry from the primary tank 12 into the auxiliary tank 14 through an outlet 54 located in the upper portion of the auxiliary tank 14. The inlet of line 48 should be located near the bottom of the primary tank 12 to ensure complete drainage of the lime slurry from the primary tank 12.

A suction line 56 (FIG. 2) having a valve 58 is provided with the auxiliary tank 14. The suction line 56 should also have an inlet located near the bottom of the auxiliary tank 14 to ensure full drainage of the lime slurry from the auxiliary tank 14. A pump 60 is provided for pumping effluent from the suction line 56 to a conduit 62 to a desired application area.

As shown in FIG. 2, the primary tank 12 is supplied with an ultrasonic level indicator 64 which is connected to a process control unit 66 which controls the pump 52. When the level indicator 64 senses that the level within the primary tank 12 is nearly or completely empty, the pump 52 is deactivated so that the flow of lime slurry from the primary tank 12 to the auxiliary tank 14 is cut off. The valve 50 may also be connected to the control unit 66 and closed off to effectively stop flow between the primary tank 12 and the auxiliary tank 14. An ultrasonic level indicator 68 is also provided with the auxiliary tank 14 and linked to the process control unit 66. The mixing paddles 32 should be spaced apart directly below the level indicators 64, 68 to form a gap so that the mixing paddles 32 do not cause the level indicators 64, 68 to misread the liquid level within the tanks 12, 14.

The control unit 66 may additionally be linked to valve 58 and pump 60 to provide smooth operation of the unit 10. Temperature indicators and warning devices (not shown) may also be provided with the primary and auxiliary tanks 12, 14 to ensure that the temperature of the lime slurry within the tanks does not exceed safe levels.

In order to provide a continuous product stream of lime slurry, the apparatus 10 is transported by means of truck or tow vehicle (not shown) to a desired area which is remote from a lime processing plant. Separate trucks or tanks are used to carry a supply of dry quicklime or hydrated lime to be used in forming the lime slurry. Once the apparatus 10 is located at the remote job site, the primary tank 12 is filled with water through the water inlet 42 to the preselected level 44 from a suitable water source. When the primary tank 12 is filled with water, the quicklime or the hydrated lime may be blown or otherwise introduced into the primary tank 12 through inlet 40 below the water level 44. As this occurs, the water/lime mixture is stirred by means of the rotatable shaft 22 and the mixing paddles 32.

Typically, the amount of lime solids may range between 20–45% by weight to that of the total lime slurry. For example, 158,000 lbs. of water may be used to fill the tank to the preselected level 44. To this may be added 50,000 lbs. (25 tons) of lime. The lime used may be either a high calcium lime or a dolomitic lime and may be either quicklime or hydrated lime. High calcium lime is usually preferable for most applications. The lime may have impurities but will ordinarily be better than 90% calcium oxide or calcium hydroxide, depending on the type of lime used.

The continuous operation of the mixing paddles 32 during the formation of the lime slurry ensures that the slurry of lime is thoroughly slaked or mixed. Once the proper concentration of lime is introduced into the primary tank 12 and mixing of the lime slurry is complete, rotation of the shaft 22 may be stopped. Valve 50 is then opened and the lime slurry is pumped through line 48 by means of the pump 52 which pumps the lime slurry through outlet 54 into auxiliary tank 14.

After the auxiliary tank 14 is filled to an initial level, the suction line 56 (FIG. 2) is opened by means of the valve 58 so that the pump 60 pumps the effluent from the suction line 56 to the conduit 62 where the product stream can be supplied to a desired area, such as a hot mix asphalt plant where a continuous supply of lime slurry is required.

The level within the auxiliary tank 14 can be controlled by monitoring the level within the auxiliary tank 14 using the level indicator 68 and regulating the flow from line 48 by means of the pump 52 and control unit 66. The amount of lime slurry pumped from the primary tank 12 to the auxiliary tank 14 should be enough to fill and maintain the level within the auxiliary tank 14 so that when the lime slurry within primary tank 12 is nearly depleted, the slurry level within the auxiliary tank 14 is high enough to provide a continuous flow of lime slurry to the desired area while a new batch of lime and water is mixed in the primary tank 12. This should be equal to at least the value of the flow rate of the lime slurry flowing out of the auxiliary tank 14 multiplied by the amount of time required to mix a new batch of water and lime slurry. Typically, the amount of time required to prepare a lime slurry using 25 tons of lime is about one and a half hours. Thus, for example, if a continuous product stream of 40 gallons/min of lime slurry is required, and it takes one and a half hours (90 min) to prepare a new batch of lime 4 slurry in the primary tank 12, the auxiliary tank 14 would have to hold at least 3600 gallons of lime slurry.

When the lime slurry within the primary tank 12 is 8 depleted, the pump 52 is deactivated and valve 50 is closed by means of the control unit 66. Once the pump 52 is deactivated and valve 50 is closed, a new water/lime mixture may be introduced into the primary tank 12 as previously discussed. Once a new lime slurry has been mixed in primary tank 12 and the concentration of lime adjusted to within an acceptable range, the valve 50 is opened and the pump 52 is activated once again to allow the new lime slurry to flow into the auxiliary tank 14 while the lime slurry is still flowing from the auxiliary tank 14 through suction line 56. This process may be repeated numerous times if necessary so that an uninterrupted, continuous supply of lime slurry is supplied to a selected application area. It should be noted that while the product stream of lime slurry is being drawn from the auxiliary tank 14, the rotatable shaft 22 and mixing paddles 32 can be rotated periodically to further mix the slurry and prevent settling of the lime solids.

Figure 3:
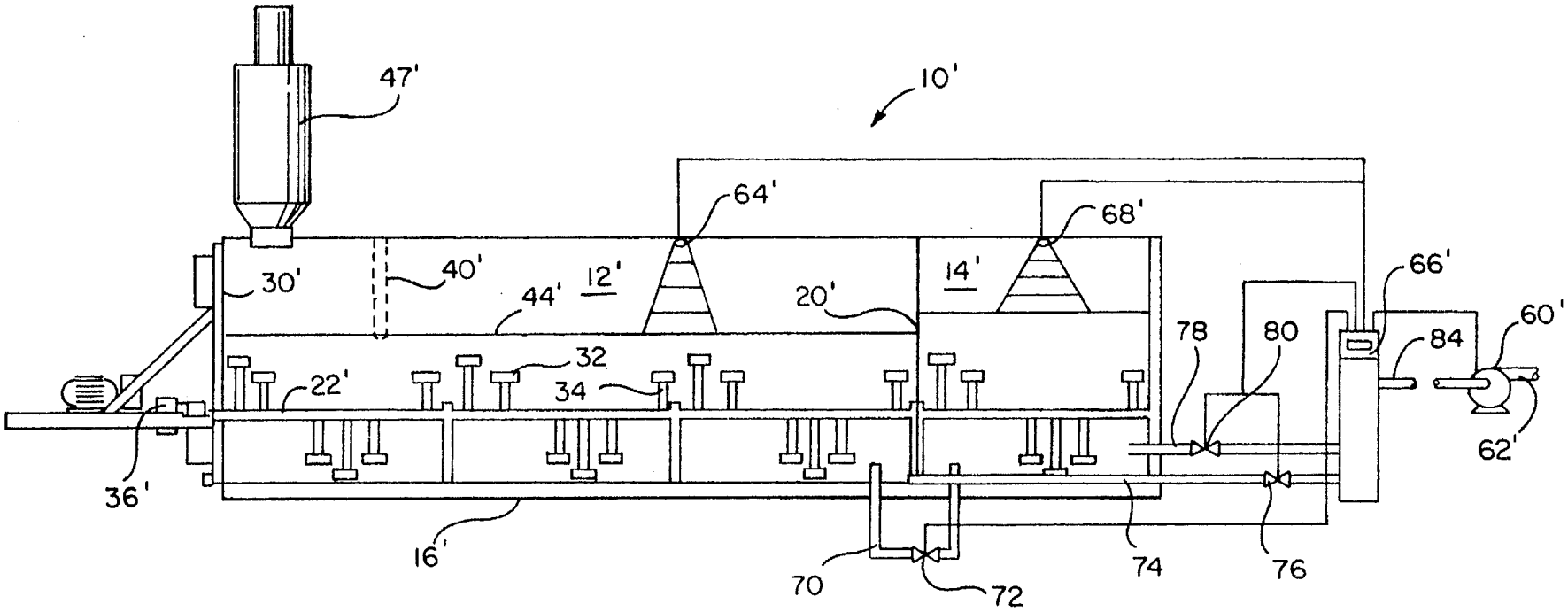
FIG. 3 is a schematic diagram of another embodiment having a portable frame with primary and auxiliary tanks mounted thereon and having conduits for drawing a product stream of lime slurry from both tanks in accordance with the invention.

FIG. 3 shows another embodiment of an apparatus 10' used for supplying a continuous product stream of lime slurry to a remote job site. The apparatus 10' is similar to that shown in FIGS. 1 and 2, with similar components being designated by a prime sign. In the embodiment of FIG. 3, a conduit 70 is provided between and in communication with the primary and auxiliary tanks 12', 14'. A valve 72 allows the conduit 70 to be selectively opened so that the lime slurry is introduced into the auxiliary tank 14'. This may be accomplished without the use of a pump when the slurry level within the auxiliary tank 14' is to be substantially the same as that in the primary tank 12'. It may also be necessary to provide a pump in conjunction with the conduit 70 in order to pump the lime slurry to the auxiliary tank 14' if it is desired that the lime slurry be at a higher level than that of the primary tank 12'.

A suction line 74 with a valve 76 is provided with the primary tank 12' for drawing the lime slurry directly from the primary tank 12'. The suction line 74 should have an inlet located at or near the bottom of the tank 12' to ensure complete drainage of the lime slurry. The auxiliary tank 14' also has a similar suction line 78 with a valve 80 for drawing lime slurry from the auxiliary tank 14'. Both suction lines 74, 78 empty into a manifold 82. An effluent conduit 84 is provided with the manifold 82 for drawing a product stream from either the auxiliary or primary tanks 12', 14' through the manifold 82 and through conduit 62' to a desired area by means of pump 60'.

Provided with the primary tank 12' is an ultrasonic level indicator 64' which is connected to the valves 76, 80 by process control unit 66'. The control unit 66' opens or closes the valves 76 and 80 to provide smooth and continuous effluent flow through the suction lines 74, 78, respectively. The control unit 66' may also be connected to valve 72 on conduit 70.

In operation, an initial lime slurry is formed in the primary tank 12' in the same manner as described for the embodiment of FIGS. 1 and 2. Once the lime slurry is formed, the valve 72 on conduit 70 is opened either manually or by means of the control unit 66' so that the lime slurry is introduced into the auxiliary tank 14'. As discussed previously, the lime slurry may either be pumped into the auxiliary tank 14' or merely allowed to flow from the primary tank 12' into the auxiliary tank 14' until the fluid levels within each tank 12', 14', as measured by the level indicators 64', 68', equilibrates. Once this occurs, the control unit 66' causes the valve 72 to close so that the supply of lime slurry within the primary tank 12' is effectively cut off from the auxiliary tank 14'.

With the valve 72 closed, the valve 76 on the suction line 74 is opened and the pump 60' is activated so that a product stream of the lime slurry from the primary tank 12' is drawn into the manifold 82, through effluent conduit 84 and out conduit 62' to the selected area.

When the level of the slurry in the primary tank 12' drops to a level where the primary tank 12' is nearly empty, the control unit 66' shuts the valve 76 to close suction line 74 and simultaneously opens the valve 80 on suction line 78. The lime slurry within the auxiliary tank 14' is thus introduced into the manifold 82 and through conduits 84 and 62' to the selected application area.

While the lime slurry is being drawn from the auxiliary tank 14', a second batch of water and lime is introduced into the primary tank 12' through conduit 40' and mixed as discussed previously. Valve 72 should remain shut while lime is being introduced and mixed within the primary tank 12'. Once the lime slurry has been mixed in primary tank 12' and the concentration of lime adjusted to within an acceptable range, the valve 72 is opened once again to allow the new lime slurry to flow into the auxiliary tank 14' while the lime slurry is still flowing from the auxiliary tank 14'. When the auxiliary tank 14' is full, the valve 80 is shut and the valve 76 is opened so that a second product stream of lime slurry flows into the manifold 82 from the primary tank 12' where it is pumped through conduit 62' to the selected area.

Alternatively, after the second lime slurry is formed in the primary tank 12', valve 80 can be shut and valve 76 opened so that the second product stream can be drawn from the primary tank 12' immediately after it is formed. Valve 72 is then opened so that the auxiliary tank 14' is filled with lime slurry from the primary tank 12' as the second product stream is being drawn from the primary tank 12'.

The method and apparatus of the invention have several advantages over the prior art. Because the primary and auxiliary tanks are mounted on a single portable frame structure, they may be transported to remote locations where it is desired to have a continuous, uninterrupted flow of lime slurry, such as in hot mix asphalt plants. The advantages of this are particularly evident when using quicklime. The hot lime slurry formed when slaking quicklime can be used almost immediately, before any significant temperature drop. There is no need to transport the lime slurry over large distances from a permanently located lime processing plant. Also, there is no need for dry lime storage, slaking equipment and separate slurry storage facilities.

While the invention has been shown in only two of its embodiments, it should be apparent to those skilled in the art that it is not so limited, but is susceptible to various changes without departing from the scope of the invention.

We claim:

1. A method for providing a continuous product stream of a slurry of particulate material to a selected area, the method comprising the steps of:

a) mounting a primary tank and an auxiliary tank to a portable frame structure;

b) positioning the portable frame structure with the primary and auxiliary tanks at the selected area;

c) introducing a quantity of particulate material and water into the primary tank;

d) mixing the water and particulate material in the primary tank to form a slurry;

e) introducing into the auxiliary tank an amount of the slurry from the primary tank;

f) drawing a product stream of the slurry from the primary tank so that slurry is supplied to the selected area until the amount of slurry within the primary tank drops to a preselected level; then g) drawing a second product stream of the slurry from the auxiliary tank so that slurry is continuously supplied to the selected area;

h) introducing a second quantity of particulate material and water into the primary tank and mixing the second quantity of particulate material and water to form a second slurry of particulate material while the second product stream of slurry is being drawn from the auxiliary tank; and then i) repeating steps (e) through (h) until a desired amount of the slurry of the particulate material is supplied to the selected area.

2. The method of claim 1, wherein:

steps (c) and (h) include introducing unslaked lime and water into the primary tank; and step (d) includes forming a slaked lime slurry.

3. The method of claim 1, wherein:

steps (c) and (h) include introducing hydrated lime and water into the primary tank.

4. The method of claim 1, wherein:

steps (c) and (h) include introducing lime and water by first introducing water into the primary tank and then adding lime to the water.

5. The method of claim 1, wherein:

steps (c) and (h) include introducing lime kiln dust and water into the primary tank.

6. The method of claim 1, wherein:

step (d) further comprises mixing the slurry within the auxiliary tank.

7. The method of claim 1, wherein:

step (e) includes introducing into the auxiliary tank an amount of slurry equal to at least the value of the volumetric flow rate of the second product stream of step (g) multiplied by the period of time required to complete step (h).

8. A method for slaking unslaked lime to provide a continuous product stream of slaked lime slurry to a selected area, the method comprising the steps of:

a) mounting a primary tank and an auxiliary tank on a portable frame structure, the primary tank having a capacity greater than the auxiliary tank;

b) positioning the portable frame structure with the primary and auxiliary tanks at the selected area;

c) introducing a quantity of unslaked lime and water into the primary tank;

d) mixing the unslaked lime and water in the primary tank to form a slaked lime slurry;

e) introducing into the auxiliary tank an amount of the slaked lime slurry from the primary tank;

f) drawing a product stream of the slaked lime slurry from the primary tank so that the slaked lime slurry is supplied to the selected area until the amount of slaked lime slurry within the primary tank drops to a preselected level; then g) drawing a second product stream of the slaked lime slurry from the auxiliary tank so that the slaked lime slurry is continuously supplied to the selected area;

h) introducing a second quantity of unslaked lime and water into the primary tank and mixing the second quantity of unslaked lime and water to form a second slaked lime slurry while the second product stream of slaked lime slurry is being drawn from the auxiliary tank; and then i) repeating steps (e) through (h) until a desired amount of slaked lime slurry is supplied to the selected area.

9. The method of claim 8, wherein:

steps (c) and (h) include first introducing the water into the primary tank and then adding unslaked lime to the water.

10. The method of claim 9, wherein:

the unslaked lime is added at a predetermined distance below the surface of the water within the primary tank.

11. The method of claim 8, wherein:

step (d) further comprises mixing the slaked lime slurry within the auxiliary tank.

12. The method of claim 8, wherein:

step (e) includes introducing into the auxiliary tank an amount of slaked lime slurry equal to at least the value of the volumetric flow rate of the second product stream of step (g) multiplied by the period of time required to complete step (h).

13. A method for providing a continuous product stream of lime slurry to a selected area, the method comprising the steps of:

a) mounting a primary tank and an auxiliary tank to a portable frame structure;

b) positioning the portable frame structure with the primary and auxiliary tanks at the selected area;

c) introducing a quantity of lime and water into the primary tank;

d) mixing the water and lime in the primary tank to form a lime slurry;

e) adding an amount of lime slurry to the auxiliary tank from the primary tank;

f) drawing a product stream of the lime slurry from the auxiliary tank so that lime slurry is supplied to the selected area while feeding lime slurry into the auxiliary tank from the primary tank to replenish the amount of lime slurry in the auxiliary tank;

g) allowing the amount of lime slurry within the primary tank to drop to a preselected level; then h) introducing a second quantity of lime and water into the primary tank and mixing the second quantity of lime and water to form a second lime slurry while the product stream of lime slurry is being drawn from the auxiliary tank; and then i) repeating steps (e) through (h) until a desired amount of lime slurry is supplied to the selected area.

14. The method of claim 13, wherein:

steps (c) and (h) include introducing unslaked lime and water into the primary tank; and step (d) includes forming a slaked lime slurry.

15. The method of claim 13, wherein:

steps (c) and (h) include introducing hydrated lime and water into the primary tank.

16. The method of claim 13, wherein:

steps (c) and (h) include introducing lime and water by first introducing water into the primary tank and then adding lime to the water.

17. The method of claim 16, wherein:

the lime is added at a predetermined distance below the surface of the water within the primary tank.

18. The method of claim 13, wherein:

step (d) further comprises mixing the lime slurry within the auxiliary tank.

19. A method for slaking unslaked lime to provide a continuous product stream of slaked lime slurry to a selected area, the method comprising the steps of:

a) mounting a primary tank and an auxiliary tank to a portable frame structure, the primary tank having a capacity greater than the auxiliary tank;

b) positioning the portable frame structure with the primary and auxiliary tanks at the selected area;

c) introducing a quantity of unslaked lime and water into the primary tank;

d) mixing the unslaked lime and water in the primary tank to form a slaked lime slurry;

e) adding an amount of the slaked lime slurry to the auxiliary tank from the primary tank;

f) drawing a product stream of the slaked lime slurry from the auxiliary tank so that slaked lime slurry is supplied to the selected area while feeding slaked lime slurry into the auxiliary tank from the primary tank to replenish the amount of lime slurry in the auxiliary tank;

g) allowing the amount of lime slurry within the primary tank to drop to a preselected level; then h) introducing a second quantity of lime and water into the primary tank and mixing the second quantity of lime and water to form a second slaked lime slurry while the product stream of lime slurry is being drawn from the auxiliary tank; and then i) repeating steps (e) through (h) until a desired amount of slaked lime slurry is supplied to the selected area.

20. The method of claim 19, wherein:

steps (c) and (h) include first introducing the water into the primary tank and then adding unslaked lime to the water.

21. The method of claim 20, wherein:

the unslaked lime is added at a predetermined distance below the surface of the water within the primary tank.

22. The method of claim 19, wherein:

step (d) further comprises mixing the slaked lime slurry within the auxiliary tank.

23. A method for providing a continuous product stream of lime slurry to a selected job site located remote from a lime production plant, the method comprising the steps of:

a) mounting a primary tank and an auxiliary tank to a portable frame structure;

b) transporting the portable frame structure with the primary and auxiliary tanks to the remote job site;

c) introducing a quantity of lime and water into the primary tank;

d) mixing the water and lime in the primary tank to form a lime slurry, whereby an exothermic reaction occurs, resulting in the formation of a hot lime slurry;

e) introducing into the second tank an amount of the hot lime slurry from the primary tank;

f) drawing a product stream of the lime slurry from the primary tank so that lime slurry is supplied to the job site until the amount of lime slurry within the primary tank is nearly depleted and the level drops to a preselected level; then g) switching the delivery of product to a second product stream of the lime slurry drawn from the auxiliary tank before the first tank is depleted so that lime slurry is continuously supplied to the selected area;

h) introducing a second quantity of lime and water into the nearly depleted primary tank and mixing the second quantity of lime and water to form a second hot lime slurry while the second product stream of lime slurry is being drawn from the auxiliary tank; and then i) before the second tank is depleted, repeating steps (e) through (h) until a desired amount of lime slurry is supplied to the job site.

24. An apparatus for providing a continuous product stream of lime slurry to a job site located remote from a lime production plant, the apparatus comprising:

a portable frame structure having a primary tank of a given capacity and an auxiliary tank of a lesser relative capacity mounted thereon, the frame having a plurality of ground engaging wheels mounted thereon and being connectable to a transport vehicle for moving the portable frame structure from one location to another;

mixing means located within the primary tank and the auxiliary tank for mixing the contents thereof;

the primary tank having a lime inlet for receiving lime supplied from a suitable source and having a fluid inlet for receiving a supply of water for forming a hot lime slurry within the primary tank, the primary tank also having an outlet opening for discharging lime slurry to the job site and for supplying lime slurry from the primary tank to the auxiliary tank; and valve means for supplying discharged lime from the primary tank to the job site until the amount of lime in the primary tank reaches a preselected level and for switching the delivery of lime slurry to the auxiliary tank before the primary tank is depleted so that lime is continuously supplied to the job site where the primary tank is refilled with lime and water.

25. The apparatus of claim 24, wherein:

the portable frame structure with the primary and auxiliary tanks is of a legal highway size.

26. The apparatus of claim 24, wherein:

the portable frame structure with the primary and auxiliary tanks has a height not greater than 13.5 feet.

27. The apparatus of claim 24, wherein:

the primary tank has a capacity not greater than about 24,000 gallons.

* * * * *